United States Patent [19]

Whitesel

[11] 4,121,279

[45] Oct. 17, 1978

[54] LAMP MODULE

[76] Inventor: J. Eric Whitesel, 5313 Grand Ave., Western Springs, Ill. 60558

[21] Appl. No.: 755,490

[22] Filed: Dec. 29, 1976

[51] Int. Cl.[2] ..... F21V 7/00

[52] U.S. Cl. ..... 362/297; 362/346; 362/367; 362/811

[58] Field of Search ..... 240/10 R, 4.2, 81 R; 350/299, 291; 272/13, 8 M, 8.5; 362/135, 140, 143, 257, 297, 311, 367, 375, 811

[56] References Cited

U.S. PATENT DOCUMENTS

| | | | |
|---|---|---|---|
| 1,886,634 | 11/1932 | Brown | 240/81 R |
| 3,610,918 | 10/1971 | Barlow | 240/10 R |
| 3,811,041 | 5/1974 | Matsushita | 240/10 R |
| 3,990,166 | 11/1976 | Nagelkirk | 40/132 D |
| 4,041,305 | 8/1977 | Dean | 362/297 |

*Primary Examiner*—J. D. Miller
*Assistant Examiner*—Peter S. Wong
*Attorney, Agent, or Firm*—J. W. Whitesel

[57] ABSTRACT

A lamp module has two sections, one superimposed over the other. One of the sections is made from one-way or partially transmitting mirrors oriented to reflect external light when the bulb is turned off and to transmit light when the bulb is turned on. The mirrors internally reflect an infinite number of images of the light bulb, thereby creating the illusion of an infinite interior space bound by a finite exterior surface. The other module section is a non-transparent housing for concealing the base of the light bulb.

7 Claims, 5 Drawing Figures

LAMP MODULE

This invention relates to lamps and more particularly to modular forms of lamps which may be used either individually (e.g., as table or floor lamps), or in combination as multiple units (e.g., as large ceiling or wall units).

The term "primary light source" is used herein to cover all devices which are used for lighting an area, room, or the like. It is intended to exclude purely decorative light sources which are designed merely to provide decorative points of interest, glowing spots, or the like, which do not really contribute to the lighting of an area.

The invention is intended to highlight the image of the dome end of a light bulb and to use reflections of such image as integral parts of the lamp design. The terms "without distortion" or "without image distortion" are used herein. To better highlight such intent, these terms distinguish over other lighting systems which are intended to conceal the source of light and to give a uniform sheet of light across a light-emitting area. For example, such a system might employ a light diffuser designed to uniformly light a transparency or a prismatic lens used to diffuse the light from a small source across a large light-emitting area.

In general, lighting fixtures and lamps primarily perform two functions. First, they provide the illumination required for visibility. Second, they provide decorative effects for either improving or enhancing the beauty of a location. It is sometimes difficult to meet these and other considerations. For example, one lamp may give an adequate amount of light, but it may also have an utilitarian appearance. Another lamp may be beautiful, but its light is poorly distributed and it is difficult to read by it. A lamp design which is adequate for a small area may be totally inadequate for a large area. If two or more of these small area lamps are used together in order to light a large area, there may be a boredom in the repetitious design.

When efforts are made to use specilized lighting to solve these and similar problems and to meet the conflicting demands of a good lighting fixture, substantial amounts of engineering and tooling may be required, which increases costs substantially. For example, when a plurality of these general purpose light fixtures are placed in a ceiling, there may be a hum drum reiteration of standardized modules. To avoid this, ceilings may be distinctively and individually decorated, but then the costs go up substantially.

Accordingly, an object of this invention is to provide new and novel lamps which meet and overcome the above-described problems of prior art lighting. Here, our object is to provide lamps which are attractive when unlit and even more attractive when lit. In particular, our object is to provide modular forms of lamps which may be assembled in a great variety of different ways.

Another object of the invention is to provide lamps which give a well distributed pattern of light and yet have an attractive appearance.

A further object is to provide a lamp having a design wherein an infinite space appears to be confined within a finite space.

Still another object of the invention is to provide a lamp having these characteristics, which also has a reflector for the back lighting, without either giving a spot light effect or appearing to be a parabolic or spherical reflector.

In keeping with an aspect of the invention, these and other objects are accomplished by providing a lamp having a decorative base and a top comprising an enclosure made of one way or partially transmitting mirrors. When a light bulb inside the lamp is turned off the one way mirrors are seen only as reflecting the light and images outside the lamp. When the light bulb inside the top is turned on the light is transmitted through the one way mirrors. The same light is reflected an infinite number of times inside the enclosure, thereby forming within the top an illusion of an apparently infinite space. Preferably, a decorative light bulb is also used to further enhance the appearance.

It is thought that the lamp may advantageously be a cube, polyhedron, or a prism, for most applications. However, any suitable geometric form may be used. By varying the size and proportions of the cubes or prisms, many different and interesting effects may be produced, without requiring any appreciable amount of extra design work. Also, the prisms may be skewed to be other than right angle prisms, in order to further vary the appearance without having to redesign the lamp.

The nature of a preferred embodiment of the invention will become more apparent from a study of the attached drawing wherein.

Figure 1:
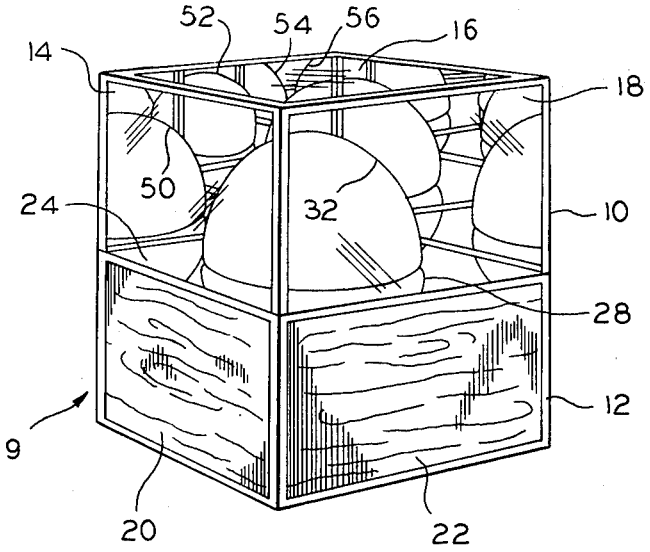
FIG. 1 is a perspective view of the inventive lamp while it is lit and internally reflecting an infinite number of images of the light bulb, thereby giving an illusion of an infinite space confined within the lamp walls.
Figure 3:
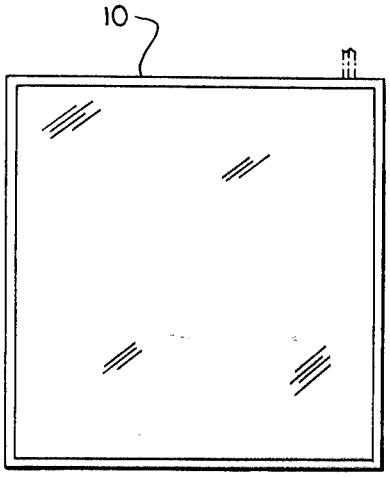
FIG. 3 is a top plan view of the lamp, with the bulb unlit.
Figure 4:
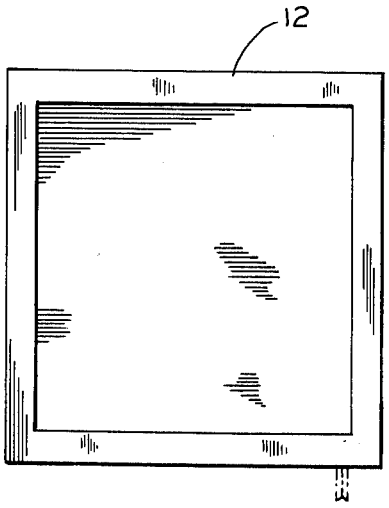
FIG. 4 is a plan view of the bottom of the lamp.
Figure 2:
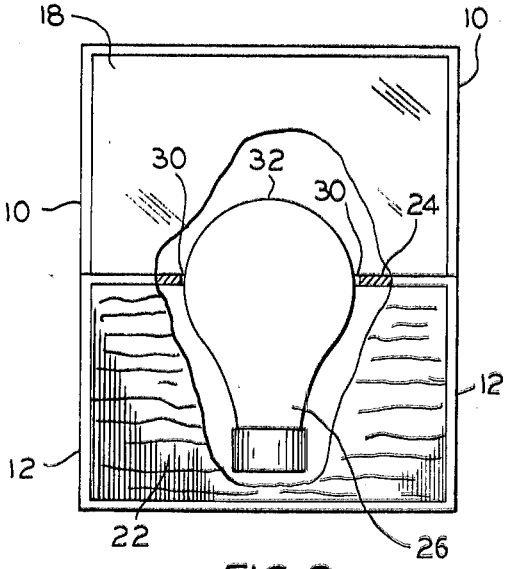
FIG. 2 is a side elevation of the lamp of FIG. 1, partly in cross section, showing the enclosed light bulb.

The inventive lamp 9 is shown in FIGS. 1–4, by way of example only, as a cube which comprises an upper half cube 10 and a lower or base half cube 12. (The terms "upper" and "lower" relate only to the orientation of the parts as shown in FIG. 1, and do not necessarily refer to either part as normally being upper or lower). The upper section 10 comprises an enclosure, here made from five panels attached to each other in an edge to edge relationship. Three of these five panels are seen in FIG. 1 at 14, 16, and 18. Each of the panels is a one-way or partially transmitting mirror which has the property of both transmitting and reflecting light from the inside to the outside of the enclosure, and of reflecting light incident upon the outside of the enclosure. The panels may be joined together in any suitable manner depending upon the desired appearance effects. In some cases, they may be leaded and in others they may be joined by chrome strips having suitable glass retaining clips along the edges thereof. These panels may also be joined together by any other suitable means, such as glue or tape.

The lower or base half 12 of the cube may have any suitable appearance and construction. More particularly, as here shown, the lower section 12 is an enclosure made from five panels (three of which panels are seen at 20, 22, 24). Four of these panels (e.g., the side panels 20, 22) form a non-transparent enclosure for concealing the base 26 of a light bulb. The fifth 24 of the five base panels is non-transparent, and has a surface for reflecting light into the upper section 10, as seen at 28. This fifth panel includes a circular hole 30 which fits around the circumference of the bulb and exposes, above its surface, the dome 32 of the bulb.

Figure 5:
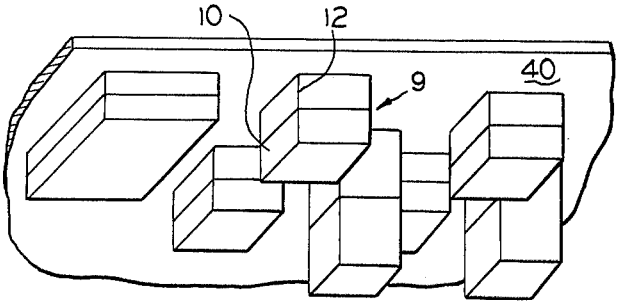
FIG. 5 shows a group of the lamp modules, of different size and shapes, assembled as an exemplary ceiling unit.

The lamp is primarily designed to be operated with the upper section 10 either up (as shown in FIG. 1) or down (as shown in FIG. 5). However, other orientations may also be used. When the lamp is operated in the position shown in FIG. 1, the bottom panels (two of which are seen at 20, 22) may be a beautifully grained wood (such as rosewood), for example. When the lamp is inverted, as shown in FIG. 5, (e.g., as attached to ceiling 40), the heat dissipating characteristics of the lamp may be the most important considerations. If the base 9 is made of sheet metal, all of the normal safe guards should be observed to avoid heat concentrating thin spots on the corners, edges, or the like. In this case, a decorative sleeve (such as either spun aluminum or chrome plated metal ) may also be fitted over the base 9, if desired. Any suitable fasteners (not shown) may be used to attach the one way mirror enclosure 10 to the lower section 9, when the module is used in its inverted position.

It should now be apparent that the base 26 of the light bulb is concealed in the lower and non-transparent base section 9 of the lamp. At least a portion of the dome 32 of the light bulb projects upwardly through the circular hole 30 of the central panel 24. Preferably, a decorative bulb is used with a generally semi-spherical dome section projecting above the surface panel 24. When the light bulb is switched on, its light shines through the one-way mirrors 14, 16, 18, and its image is reflected infinitely, inside the upper section, as the image echos from mirror to mirror in an endless pattern, as seen at 52, 54, 56.

If it is desirable to have more light or to cover a larger area, the module may be repeated any number of times and in any size or shape, or a variety of sizes and shapes. These modules may be mounted side-by-side in an array, as shown in FIG. 5. The array may be given a greater variety and a more interesting appearance by varying the size, shape, and proportions of the modules. These modules may be arranged in regular patterns, or they may be scattered and positioned at random.

Hence, it is seen that the invention provides a general purpose light module having great flexibility. It is readily adaptable for use in any of many different installations and operations. Accordingly, the following claims should be construed broadly enough to include all equivalent structures falling within the true scope and spirit of the invention.

I claim:

1. A household type of lamp for internal lighting within a building, said lamp comprising a primary light source having first and second sections, the first of said sections including means for supporting the base of a light bulb with its dome projecting upwardly above said first section and into said second section, said second section comprising partially light-transmitting mirror means surrounding the dome of said bulb for reflecting ambient light outwardly and the light of said bulb inwardly and for transmitting light outwardly, the area between said dome and said mirror means being free of image-blocking structures, whereby said dome is not easily seen when said bulb is not lit and the image of said dome is internally reflected without distortion and the ambient area is lit, when the bulb lit, the lit bulb being reflected inwardly without image distortion an infinite number of times within said second section, said first and second sections have a common image-reflecting panel which closely surrounds the circumference of said dome, conceals the base of said light bulb and reflects the image of said dome without image distortion into said second section.

2. The lamp of claim 1 wherein said first and second sections fit together with their outside walls forming a prism and with said common panel dividing said prism.

3. The lamp of claim 2 wherein said prism is a cube.

4. The lamp of claim 1 wherein said second section comprises a plural of planar, partially transmitting mirror panels joined together in edge-to-edge relationships in order to form a five-sided cup-like enclosure which reflects ambient light toward the outside of said cup when the light bulb is off.

5. The lamp of claim 4 wherein there are five of said mirror panels in said second section which fit together in order to form the five panels of a second half cube and said first section comprises at least five panels, four of which are the side panels of a mating first half cube and the fifth of which is an end panel of said first half cube, said fifth and end panel being a panel which is common to said first and second half cubes with a circular hole in said common panel, said circular hole substantially fitting around the circumference of the dome of said bulb.

6. A process for displaying light comprising the steps of:

(a) enclosing a household type of light bulb which is large enough to be a primary light source for interior household lighting in a lamp housing, said housing comprising a semi-transparent portion having the property of both transmitting and reflecting light from one side and of reflecting light from the other side, said semi-transparent portion being completely free of all obstructions between said bulb and said semi-transparent portion, whereby the image of said bulb is reflected without distortion;

(b) enclosing the base of said light bulb in a non-transparent enclosure having the property or concealing the light from said bulb;

(c) fitting said semi-transparent portion over said non-transparent portion in a superimposed relationship; and (d) placing an intermediate panel having image-reflective characteristics between said portions and closely surrounding said light bulb to reflect without distortion the image of the top of said bulb toward said semi-transparent portion and to preclude transmission of light from said base of said light bulb in said non-transparent enclosure to said semi-transparent enclosure.

7. The process of claim 6 wherein said two enclosures fit together to form a cube.

* * * * *